US009052673B2

(12) United States Patent
Kondo et al.

(10) Patent No.: US 9,052,673 B2
(45) Date of Patent: Jun. 9, 2015

(54) STRUCTURAL MEMBER, IMAGE FORMING APPARATUS AND DRIVE TRANSMITTING MECHANISM

(71) Applicant: FUJI XEROX CO., LTD., Tokyo (JP)

(72) Inventors: Takayuki Kondo, Kanagawa (JP); Takuji Matsumoto, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 41 days.

(21) Appl. No.: 13/753,012

(22) Filed: Jan. 29, 2013

(65) Prior Publication Data

US 2013/0322924 A1 Dec. 5, 2013

(30) Foreign Application Priority Data

May 30, 2012 (JP) ..... 2012-123595

(51) Int. Cl.
*G03G 21/18* (2006.01)
*G03G 15/00* (2006.01)

(52) U.S. Cl.
CPC ..... *G03G 15/757* (2013.01)

(58) Field of Classification Search
CPC ..... G03G 21/1803; G03G 21/185; G03G 21/1857; G03G 21/186; G03G 21/1864
USPC ..... 399/111, 113, 119, 167
See application file for complete search history.

(56) References Cited

U.S. PATENT DOCUMENTS

| | | | | |
|---|---|---|---|---|
| 7,236,722 | B2 * | 6/2007 | Portig | 399/167 |
| 8,855,534 | B2 * | 10/2014 | Jung et al. | 399/167 |
| 2006/0285880 | A1 * | 12/2006 | Okabe | 399/111 |
| 2008/0260428 | A1 * | 10/2008 | Ueno et al. | 399/167 |
| 2010/0303503 | A1 * | 12/2010 | Woo | 399/167 |

FOREIGN PATENT DOCUMENTS

JP A-07-160174 6/1995

* cited by examiner

*Primary Examiner* — Clayton E Laballe
*Assistant Examiner* — Ruifeng Pu
(74) *Attorney, Agent, or Firm* — Oliff PLC

(57) ABSTRACT

Provided is a structural member including an image holding member that holds a latent image, a developing member that develops the latent image, a first driven side coupling portion that is connectable to a first driving side coupling portion and transmits a driving force to the image holding member, and a second driven side coupling portion that is connectable to a second driving side coupling portion and transmits the driving force to the developing member, wherein the first driven side coupling portion includes a first engaged portion that is engaged with a first engaging portion provided on the first driving side coupling portion at no more than two engagement places, and the second driven side coupling portion includes a second engaged portion that is engaged with a second engaging portion provided on the second driving side coupling portion at three or more engagement places.

14 Claims, 14 Drawing Sheets

STRUCTURAL MEMBER, IMAGE FORMING APPARATUS AND DRIVE TRANSMITTING MECHANISM

CROSS-REFERENCE TO RELATED APPLICATIONS

This application is based on and claims priority under 35 USC 119 from Japanese Patent Application No. 2012-123595 filed May 30, 2012.

BACKGROUND

1. Technical Field

The present invention relates to a structural member, an image forming apparatus and a drive transmitting mechanism.

2. Summary

According to an aspect of the invention, there is provided a structural member including: an image holding member that holds a latent image while being rotated; a developing member that develops the latent image which is held by the image holding member while being rotated; a first driven side coupling portion that is connectable to a first driving side coupling portion and transmits a driving force to the image holding member, being driven by the first driving side coupling portion; and a second driven side coupling portion that is connectable to a second driving side coupling portion and transmits the driving force to the developing member, being driven by the second driving side coupling portion, wherein the first driven side coupling portion includes a first engaged portion that is engaged with a first engaging portion which is provided on the first driving side coupling portion at no more than two engagement places, and wherein the second driven side coupling portion includes a second engaged portion that is engaged with a second engaging portion which is provided on the second driving side coupling portion at three or more engagement places.

BRIEF DESCRIPTION OF THE DRAWINGS

Exemplary embodiments of the present invention will be described in detail based on the following figures, wherein:

FIG. 6 shows a first connecting member and a second connecting member which are disposed on the inner side surface;

DETAILED DESCRIPTION

Hereafter, an exemplary embodiment of the present invention will be described with reference to the drawings.

Figure 1:
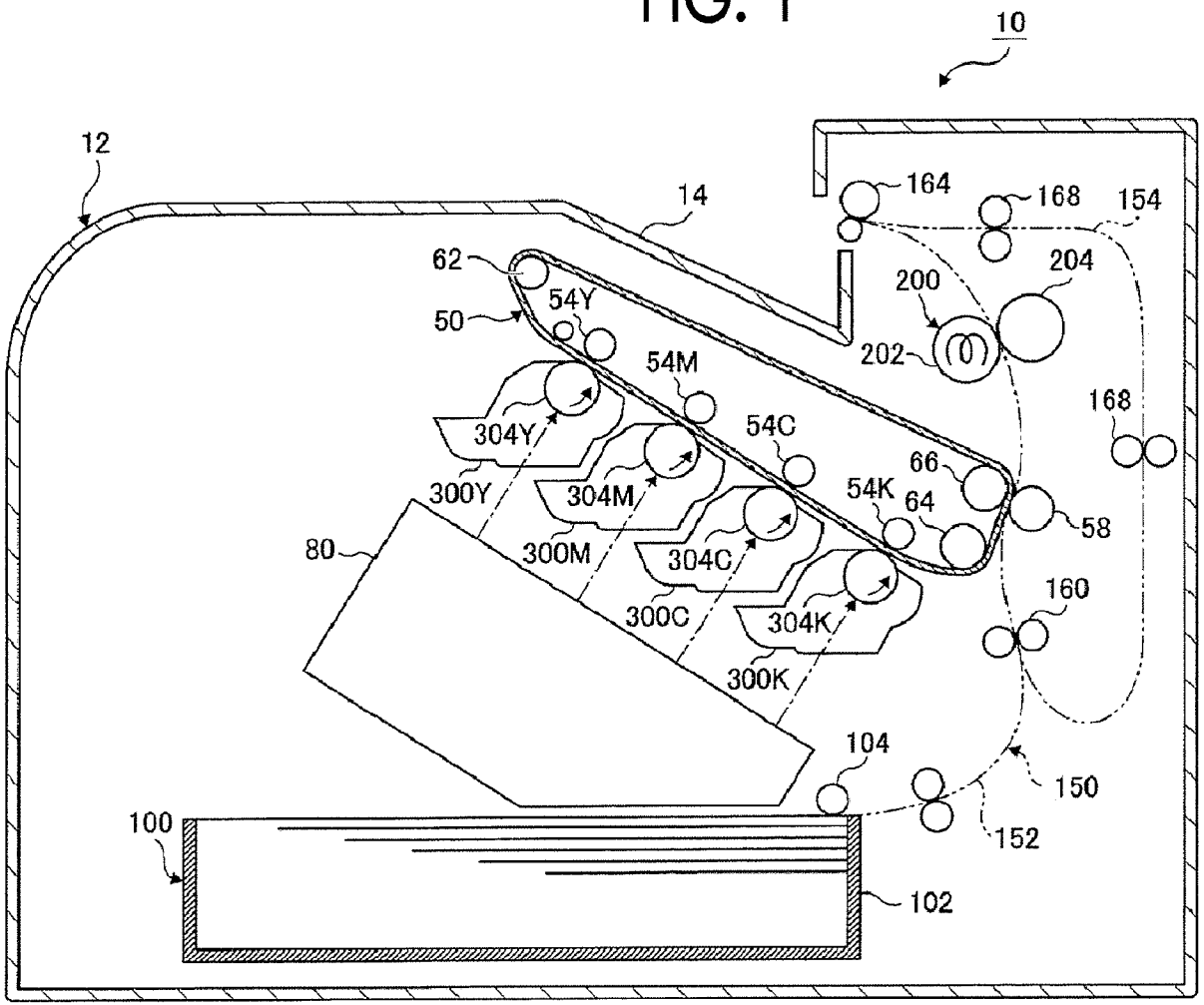
FIG. 1 is a cross-sectional view showing an image forming apparatus according to an exemplary embodiment of the invention when seen from a front side thereof.

FIG. 1 shows an image forming apparatus 10 according to the exemplary embodiment of the present invention. As shown in FIG. 1, the image forming apparatus 10 includes an image forming apparatus main body 12 of which an upper portion is an exhaust portion 14 exhausting a paper sheet used as a recording medium.

Furthermore, the image forming apparatus main body 12 includes a transfer unit 50, a latent image forming unit 80, a paper feeding unit 100, a fixing unit 200, a structural member 300Y, a structural member 300M, a structural member 300C and a structural member 300K. In addition, a transport path 150 used for transporting a paper sheet is formed inside the image forming apparatus 10.

Each of the structural member 300Y, the structural member 300M, the structural member 300C and the structural member 300K is able to be attached to/detached from the image forming apparatus main body 12 from the front side (the front side in FIG. 1), for example, and includes a photoreceptor drum 304Y, a photoreceptor drum 304M, a photoreceptor drum 304C and a photoreceptor drum 304K respectively. In addition, the structural member 300Y, the structural member 300M, the structural member 300C and the structural member 300K respectively form a developer image of yellow, magenta, cyan and black by using a yellow developer, a magenta developer, a cyan developer and a black developer on the photoreceptor drum 304Y, the photoreceptor drum 304M, the photoreceptor drum 304C and the photoreceptor drum 304K. Details of the structural member 300Y, the structural member 300M, the structural member 300C and the structural member 300K will be described below.

Each of the photoreceptor drum 304Y, the photoreceptor drum 304M, the photoreceptor drum 304C and the photoreceptor drum 304K is rotated in the direction of the arrow shown in FIG. 1 by a driving force being respectively transmitted thereto. Also, each of the photoreceptor drum 304Y, the photoreceptor drum 304M, the photoreceptor drum 304C and the photoreceptor drum 304K is used as an image holding member which holds an image and is used as a first rotating member.

The transfer unit 50 includes an intermediate transfer member 52, a primary transfer roll 54Y, a primary transfer roll 54M, a primary transfer roll 54C, a primary transfer roll 54K and a secondary transfer roll 58. The intermediate transfer member 52 is formed in an endless belt shape, for example, and is supported by a support roll 62, a support roll 64 and a support roll 66. Additionally, the intermediate transfer member 52 is rotated in a stretched state. A primary transfer bias is applied to each of the primary transfer roll 54Y, the primary transfer roll 54M, the primary transfer roll 54C and the primary transfer roll 54K, whereby an image made of a developer, which is formed on a surface of each of the photoreceptor drum 304Y, the photoreceptor drum 304M, the photoreceptor drum 304C and the photoreceptor drum 304K, is transferred to the intermediate transfer member 52. A secondary transfer bias is applied to the secondary transfer roll 58, whereby a developer held by the intermediate transfer member 52 is transferred to a paper sheet.

In the exemplary embodiment, the support roll 66 is used as a driving roll which transmits a driving force to the intermediate transfer member 52 and the driving force from a driving source such as a motor is transmitted by a drive transmitting mechanism or the like of which the illustration is omitted. The support roll 66 is rotated by the transmitted driving force, and rotates the intermediate transfer member 52 in the direction of the arrow shown in FIG. 1. Also, in the exemplary embodiment, the support roll 66 faces the secondary transfer roll 58 interposing the intermediate transfer member 52 therebetween and is used as a backup roll. In addition, the support roll 64 is used as a tension roll which applies tension to the intermediate transfer member 52 and the tension of the intermediate transfer member 52 can be reduced by moving the support roll 64 in the inner direction of the intermediate transfer member 52.

The latent image forming unit 80 forms a latent image through radiating a laser beam onto the surface of each of the photoreceptor drum 304Y, the photoreceptor drum 304M, the photoreceptor drum 304C and the photoreceptor drum 304K which is evenly charged by a charging unit mentioned below (see a charging unit 308Y of FIG. 2, for example).

The fixing unit 200 includes a heating roll 202 to heat a paper sheet and a pressure roll 204 to pressure the paper sheet to the heating roll 202.

The paper feeding unit 100 includes, for example, a paper accommodation portion 102 which accommodates paper sheets in a stacked state and a sending roll 104 which sends a paper sheet accommodated in the paper accommodation portion 102.

The transport path 150 includes a main transport path 152 and a reverse transport path 154. The main transport path 152 is a transport path in which a paper sheet is transported from the paper feeding unit 100 toward the secondary transfer roll 58 and the paper sheet is transported from the secondary transfer roll 58 toward the fixing unit 200 and then the paper sheet is transported so as to be exhausted from the fixing unit 200 to the exhaust portion 14. Along the main transport path 152, the above-mentioned paper feeding unit 100, a resist roll 160, the above-mentioned secondary transfer roll 58, the above-mentioned fixing unit 200 and an exhaust roll 164 are provided in sequence from the upstream side in a paper transporting direction.

The resist roll 160 temporarily stops the movement of a leading edge of the paper sheet, which is to be transported toward the secondary transfer roll 58, toward the secondary transfer roll 58 and then restarts the movement of the leading edge of the paper sheet toward the secondary transfer roll 58 so as to be matched with a timing of a portion of the intermediate transfer member 52 where a developer image is transferred being reached a position of the secondary transfer roll 58.

The exhaust roll 164 transports the paper sheet on which a developer image is fixed in the fixing unit 200, toward the exhaust portion 14. Moreover, the exhaust roll 164 is able to rotate in both directions of which one is the direction of discharging the paper sheet to the exhaust portion 14 and the other is the direction of transporting the paper sheet from the exhaust portion 14 side to the reverse transport path 154. The reverse transport path 154 is a transport path used for printing an image on the other surface of the paper sheet on which an image is formed on one surface thereof and transports the paper sheet from the exhaust roll 164 to the upstream side of the resist roll 160. For example, two of reverse transport rolls 168 are provided along the reverse transport path 154. In the case of forming an image on the other surface of the paper sheet on which an image is formed on one surface thereof, the exhaust roll 164 rotates in a reverse direction in a state in which the exhaust roll 164 contacts the trailing edge of the paper sheet on which an image is formed and then the trailing edge of the paper sheet is guided to the reverse transport path 154. Thereby, the paper sheet is transported to the resist roll 160.

Figure 2:
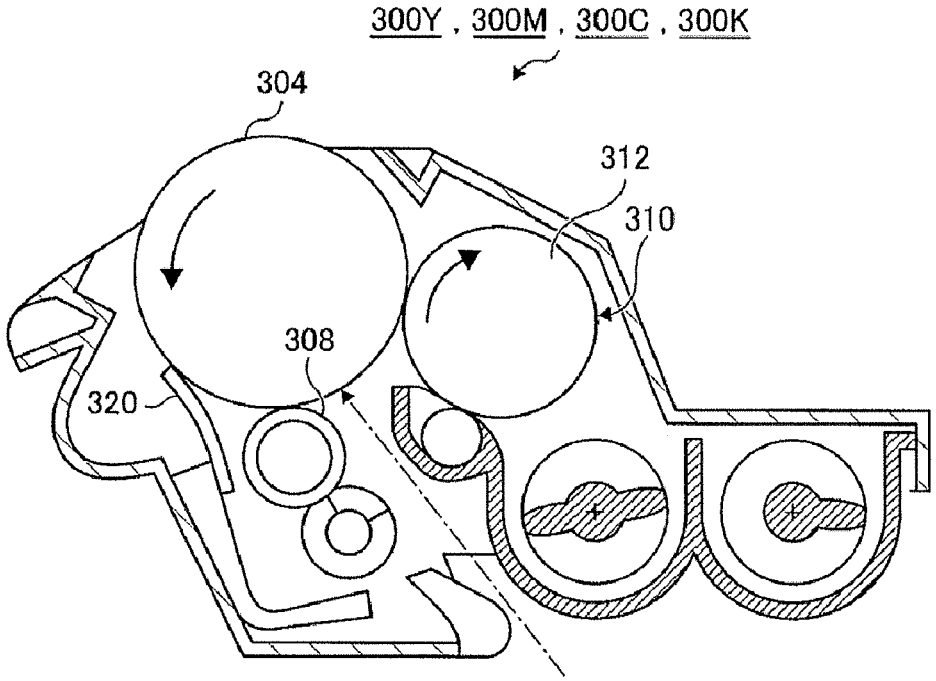
FIG. 2 is a cross-sectional view showing a structural member, which is included in the image forming apparatus shown in FIG. 1, when seen from the back side thereof.

In FIG. 2, a cross-sectional surface of the structural member 300Y, the structural member 300M, the structural member 300C and the structural member 300K from the back side (which is an illustration when seen from the back side toward the front side in FIG. 1) thereof is shown. Although the color of a developer used to each of the structural member 300Y, the structural member 300M, the structural member 300C and the structural member 300K differs one another, the structural member 300Y, the structural member 300M, the structural member 300C and the structural member 300K have the same structural member. Therefore, in the following description, the structural member 300Y, the structural member 300M, the structural member 300C and the structural member 300K are collectively described as a structural member 300 unless there is a particular need to distinguish therebetween.

As shown in FIG. 2, the structural member 300 includes the above-mentioned photoreceptor drum 304, a charging unit 308, a developing unit 310 and a cleaning unit 320. The charging unit 308 includes a charging roll, for example, and evenly charges the surface of the photoreceptor drum 304.

The developing unit 310 includes a developing roller 312 and supplies a developer to the photoreceptor drum 304 by the developing roller 312. Also, the developing unit 310 develops a latent image formed on the surface of the photoreceptor drum 304 using the developer. The developing roller 312 is used as a developer holding member which holds the developer used for developing the latent image which is held in the photoreceptor drum 304. Furthermore, the developing roller 312 is used as a second rotating member as well.

The cleaning unit 320 includes a cleaning blade which is a plate-shaped cleaning member, for example, and cleans the photoreceptor drum 304 by scraping the developer remaining on the surface of the photoreceptor drum 304 after a developer image is transferred to the intermediate transfer member 52.

Figure 3:
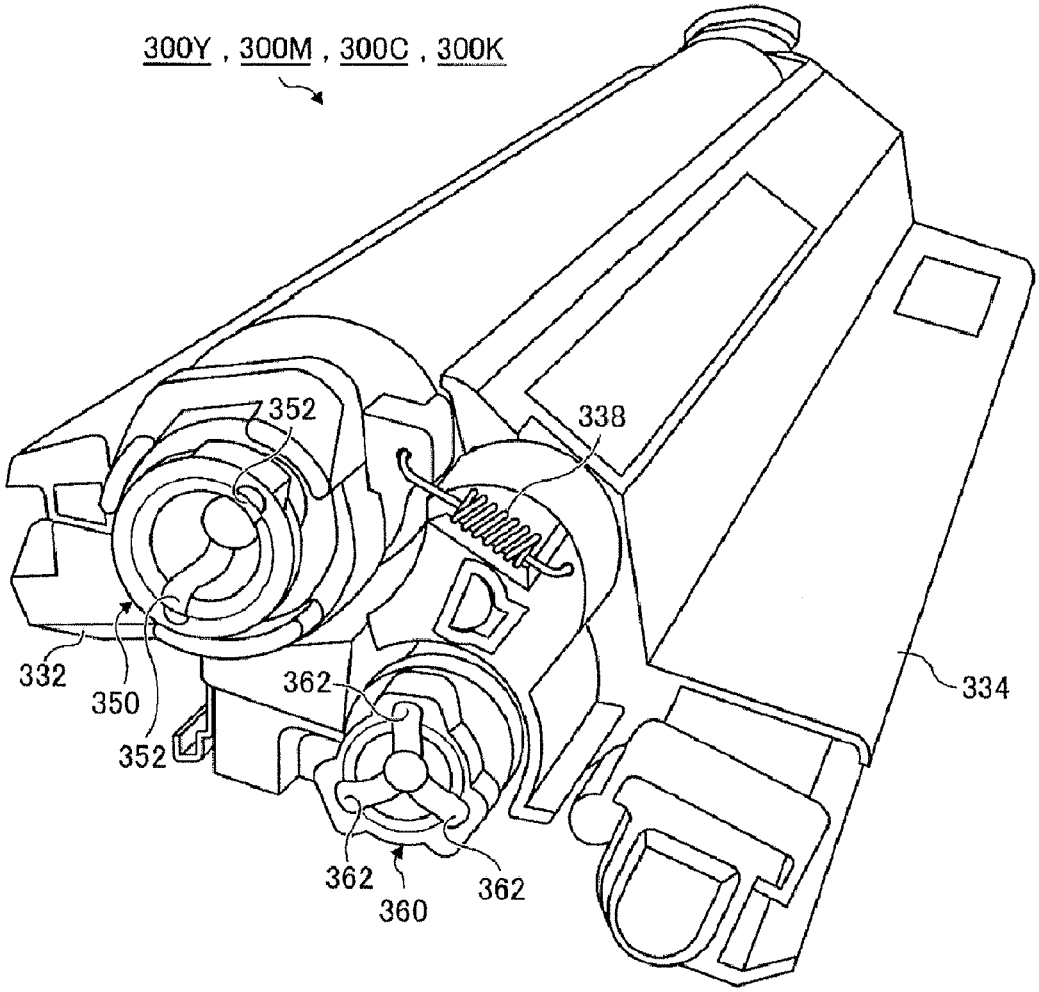
FIG. 3 is a perspective view showing the structural member shown in FIG. 2 when seen from the back side thereof.
Figure 4:
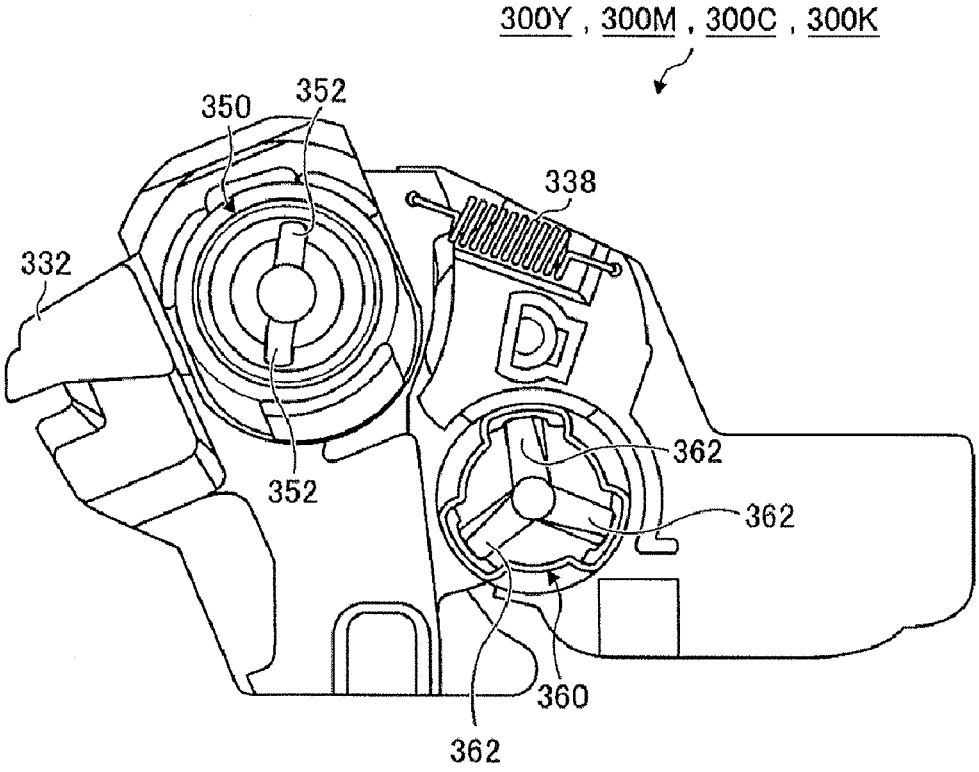
FIG. 4 shows a back of the structural member shown in FIG. 2.

FIG. 3 is a perspective view showing the structural member 300 from the backside thereof and FIG. 4 is a back view of the structural member 300. As shown in FIGS. 3 and 4, the structural member 300 includes a first housing member 332 and a second housing member 334. The above-mentioned photoreceptor drum 304, the charging unit 308 and the cleaning unit 320 (see FIG. 2) are mounted in the first housing member 332. The above-mentioned developing roller 312 (see FIG. 2) is mounted in the second housing member 334 so as to contact or be adjacent to the above-mentioned photoreceptor drum 304. Also, the second housing member 334 is used as a housing of the developing unit 310 and accommodates a developer therein.

A first driven side coupling member 350 is mounted on the outside of the first housing member 332. The first driven side coupling member 350 is able to be connected to a first connecting member 402 mentioned below (see FIG. 7, for example) and is used as a first driven side coupling portion which transmits a driving force to the photoreceptor drum 304, being driven by the first connecting member 402. Also, for example, two first groove portions 352 which are used as first portions to be engaged are formed on the first driven side coupling member 350. In the exemplary embodiment, although two first groove portions 352 are formed at a phase of 180 degrees on the first driven side coupling member 350, the number of grooves to be engaged with a first fore-end side protrusion 404 mentioned below of the first connecting member 402 may be equal to or less than 2 with regard to the number of first groove portions 352 formed on the first driven side coupling member 350. Moreover, one first groove portion 352 may be formed instead of forming two first groove portions 352 on the first driven side coupling member 350 and one first fore-end side protrusion 404 may be formed.

A second driven side coupling member 360 is mounted on the outside of the second housing member 334. The second driven side coupling member 360 is able to be connected to a second connecting member 432 mentioned below (see FIG. 7, for example) and is used as a second driven side coupling portion which transmits a driving force to the developing roller 312, being driven by the second connecting member 432. Also, for example, three second groove portions 32 which are used as a second engaged portion are formed on the second driven side coupling member 360. In the exemplary embodiment, although three second groove portions 362 are formed at a phase of 120 degrees on the second driven side coupling member 360, the number of grooves to be engaged with a second fore-end side protrusion 434 mentioned below of the second connecting member 432 may be equal to or more than 3, with regard to the number of second groove portions 362 formed on the second driven side coupling member 360. Moreover, four second groove portions 362 may be formed instead of forming three second groove portions 362 on the second driven side coupling member 360 and four second fore-end side protrusions 434 may be formed, for example.

Figure 5:
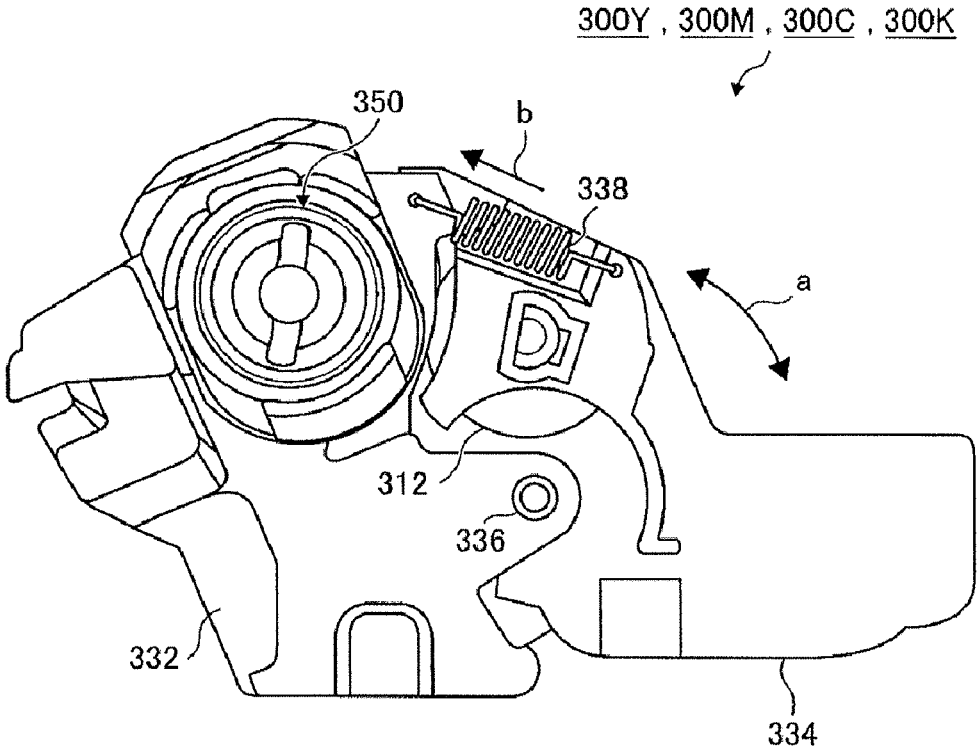
FIG. 5 shows the back of the structural member shown in FIG. 2 in a state in which a second driven side coupling member is removed.

A back of the structural member 300 in a state in which the second driven side coupling member 360 is removed is shown in FIG. 5. As shown in FIG. 5, the second housing member 334 is installed to the first housing member 332 by using a shaft member 336 so as to be movable toward the first housing member 332. More specifically, the second housing member 334 is installed to the first housing member 332 so as to be rotatable in the direction of the arrow a shown in FIG. 5 around the shaft member 336 as a center with respect to the first housing member 332.

An elastic member 338 which is formed of a coil spring or the like and used as an urging member is mounted so as to bridge the hole which is formed on the upper end portion side of the first housing member 332 and the hole which is formed on the upper end portion side of the second housing member 334. The elastic member 338 urges the upper end portion side of the second housing member 334 by pulling in the direction of the arrow b shown in FIG. 5 such that the upper end portion side of the second housing member 334 is adjacent to the upper end portion side of the first housing member 332. Furthermore, the upper end portion side of the second housing member 332 is urged by the elastic member 338, whereby the developing roller 312 is pushed to the photoreceptor drum 304 with a predetermined contact pressure. Thereby, the developing roller 312 is precisely positioned with respect to the photoreceptor drum 304. By providing a tracking roll (which is a positioning roll) at, for example, both ends of the developing roller 312, the developing roller 312 and the photoreceptor drum 304 may be adjacent to each other in a state in which a constant interval is held.

Figure 6:
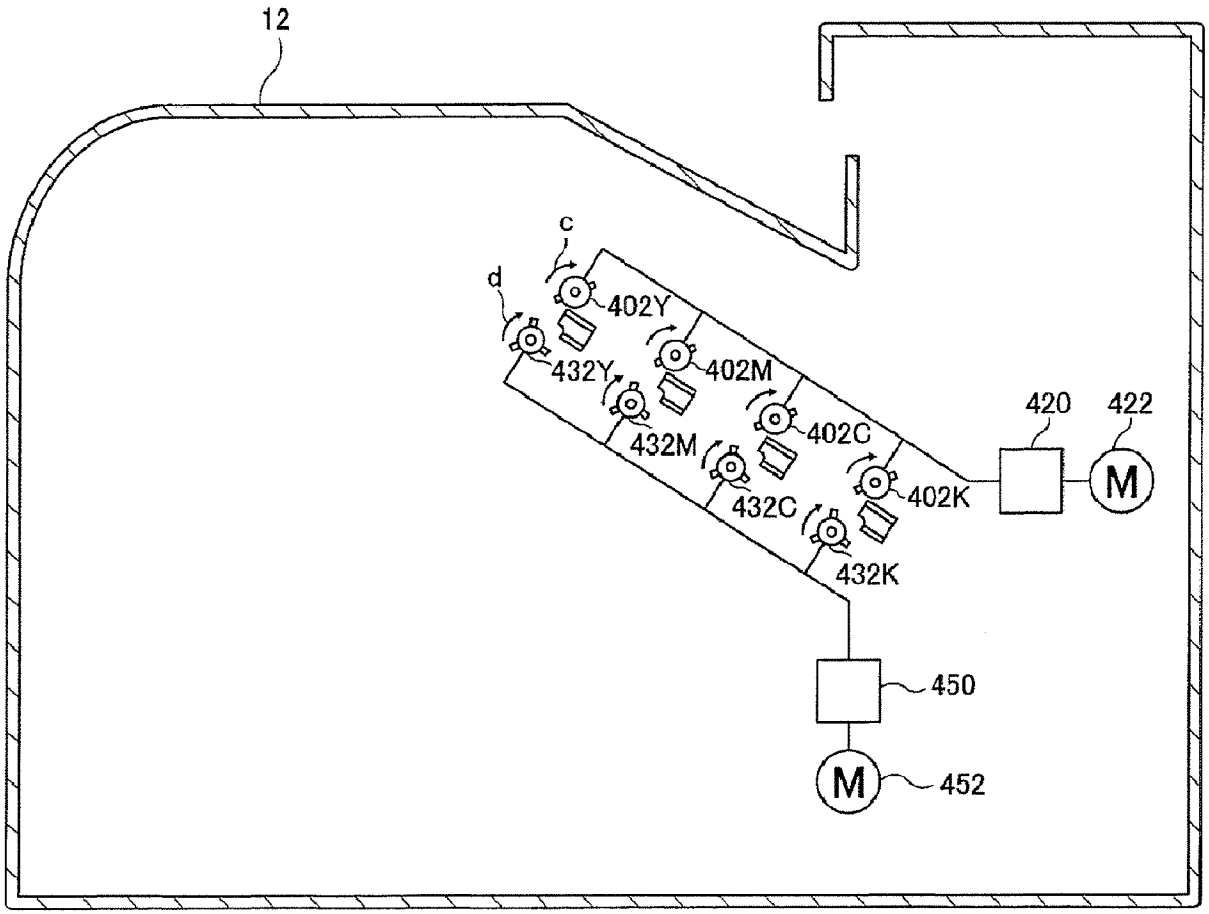
FIG. 6 shows an inner side surface of an image forming apparatus main body which is included in the image forming apparatus shown in FIG. 1, also.

The inner side of the back side surface of the image forming apparatus main body 12 is shown in FIG. 6. Furthermore, FIG. 6 shows a state in which the structural member 300Y, the structural member 300M, the structural member 300C and the structural member 300K are removed from the image forming apparatus main body 12. Also, an illustration of the latent image forming unit 80, the paper feeding unit 100, the fixing unit 200 and the like is omitted in FIG. 6.

As shown in FIG. 6, a first connecting member 402Y, a first connecting member 402M, a first connecting member 402C and a first connecting member 402K are installed in the image forming apparatus main body 12 so as to protrude toward the inside of the image forming apparatus main body 12. The first connecting member 402Y, the first connecting member 402M, the first connecting member 402C and the first connecting member 402K constitute apart of a first driving side coupling portion to which the first driven side coupling member 350Y, the first driven side coupling member 350M, the first driven side coupling member 350C and the first driven side coupling member 350K are connected. A driving source 422, such as a motor, is connected to the first connecting member 402Y, the first connecting member 402M, the first connecting member 402C and the first connecting member 402K via a transmitting system 420 which is composed of plural gears or the like. Also, the first connecting member 402Y, the first connecting member 402M, the first connecting member 402C and the first connecting member 402K rotate in the direction of the arrow c shown in FIG. 6 by a driving force being transmitted from the driving source 422.

When the structural member 300Y, the structural member 300M, the structural member 300C and the structural member 300K are mounted to the image forming apparatus main body 12, the first driven side coupling member 350Y, the first driven side coupling member 350M, the first driven side coupling member 350C and the first driven side coupling member 350K are connected with the first connecting member 402Y, the first connecting member 402M, the first connecting member 402C and the first connecting member 402K respectively.

Furthermore, a second connecting member 432Y, a second connecting member 432M, a second connecting member 432C and a second connecting member 432K are installed in the image forming apparatus main body 12 so as to protrude toward the inside of the image forming apparatus main body 12. The second connecting member 432Y, the second connecting member 432M, the second connecting member 432C and the second connecting member 432K constitute a part of the first driving side coupling portion to which the second driven side coupling member 360Y, the second driven side coupling member 360M, the second driven side coupling member 3600 and the second driven side coupling member 360K are connected.

A driving source 452, such as a motor, is connected to the second connecting member 432Y, the second connecting member 432M, the second connecting member 432C and the second connecting member 432K via a transmitting system 450 which is composed of plural gears or the like. Also, the second connecting member 432Y, the second connecting member 432M, the second connecting member 432C and the second connecting member 432K are rotated in the direction of the arrow d shown in FIG. 6 by a transmitted driving force from the driving source 452.

When the structural member 300Y, the structural member 300M, the structural member 300C and the structural member 300K are mounted to the image forming apparatus main body 12, the second driven side coupling member 360Y, the second driven side coupling member 360M, the second driven side coupling member 360C and the second driven side coupling member 360K are connected with the second connecting member 432Y, the second connecting member 432M, the second connecting member 432C and the second connecting member 432K respectively.

Figure 7:
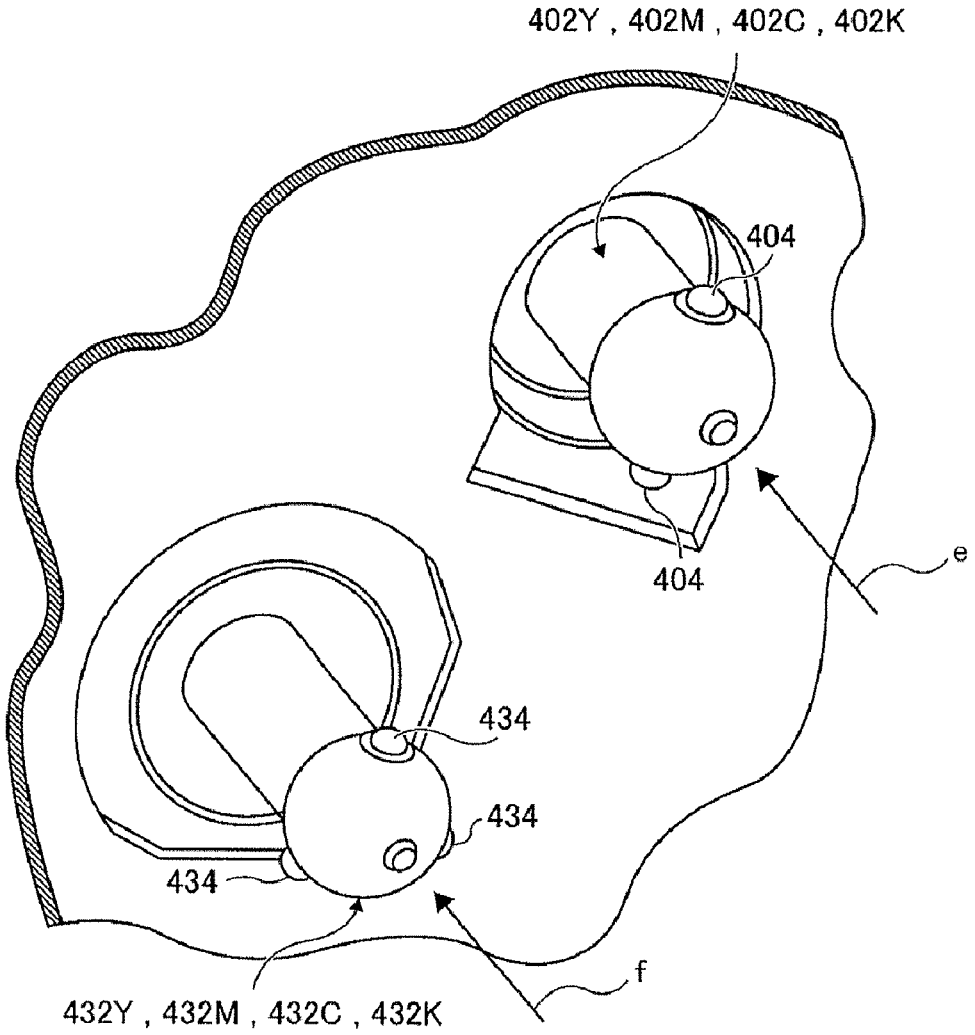
FIG. 7 is an enlarged perspective view of the first connecting member and the second connecting member shown in FIG. 6.

In FIG. 7, the first connecting member 402Y, the first connecting member 402M, the first connecting member 4020 and the first connecting member 402K, and the second connecting member 432Y, the second connecting member 432M, the second connecting member 432C and the second connecting member 432K are shown. Configurations of the first connecting member 402Y, the first connecting member 402M, the first connecting member 402C and the first connecting member 402K are the same. Therefore, in the following description, the first connecting member 402Y, the first connecting member 402M, the first connecting member 402C and the first connecting member 402K are collectively described as the first connecting member 402 unless there is a particular need to distinguish therebetween. Also, configurations of the second connecting member 432Y, the second connecting member 432M, the second connecting member 432C and the second connecting member 432K are the same. Therefore, in the following description, the second connecting member 432Y, the second connecting member 432M, the second connecting member 432C and the second connecting member 432K are collectively described as the second connecting member 432 unless there is a particular need to distinguish therebetween.

In the first connecting member 402, a fore-end is thicker than the other part as shown in FIG. 7 and, for example, two of the first fore-end side protrusions 404 which are used as a first engaging portion are formed on the thicker portion. In the exemplary embodiment, although two first fore-end side protrusions 404 are formed on the first connecting member 402, the number of first fore-end side protrusions 404 which are formed on the first connecting member 402 may be equal to or less than 2. Moreover, one first fore-end side protrusion 404 may be formed instead of forming two first fore-end side protrusions 404 on the first connecting member 402. That is, the number of engagements between the first groove portion 352 (see FIG. 3) which is formed on the first driven side coupling member 350 and the first fore-end side protrusion 404 which is formed on the first connecting member 402 is equal to or less than 2.

Also, in the second connecting member 432, a fore-end is thicker than the other portion thereof and, for example, three of the second fore-end side protrusions 434 which are used as a second engaging portion are formed on the thicker portion. In the exemplary embodiment, although three second fore-end side protrusions 434 are formed on the second connecting member 432, the number of second fore-end side protrusions 434 which are formed on the second connecting member 432 may be equal to or more than 3. Moreover, four second fore-end side protrusion 434 may be formed, for example, instead of forming three second fore-end side protrusions 434 on the second connecting member 432. That is, the number of engagement places between the second groove portion 362 (see FIG. 3) which is formed on the second driven side coupling member 360 and the second fore-end side protrusion 434 which is formed on the second connecting member 432 is equal to or more than 3.

The arrow e shown in FIG. 7 shows the movement direction of the first driven side coupling member 350 which moves toward the first connecting member 402 when the structural member 300 is mounted to the image forming apparatus main body 12. Also, the arrow f shown in FIG. 7 shows the movement direction of the second driven side coupling member 360 which moves toward the second connecting member 432 when the structural member 300 is mounted to the image forming apparatus main body 12.

As described above, the structural member 300 is able to be attached to/detached from the image forming apparatus main body 12. In order to be attachable/detachable, some extent of a gutter (interval) is provided between the structural member 300 and a mounting portion (not shown) of the image forming apparatus main body 12. Therefore, when the structural member 300 is mounted to the image forming apparatus main body 12, eccentricity (that is, a parallel error) or angle of deviation (that is, an angle error) which is an axis misalignment occurs between a driving shaft of the image forming apparatus main body 12 side (such as the first connecting member 402) and a following shaft of the structural member 300 side (such as the first driven side coupling member 350).

Meanwhile, a required function or performance is different between the photoreceptor drum 304 and the developing roller 312. Specifically, it is preferable to prevent an angular velocity variation from occurring in the photoreceptor drum 304. This is because, if the angular velocity variation occurs, elongation or contraction could occur in the developer image which is formed on the photoreceptor drum 304. In addition, if elongation or contraction occurs in the developer image, elongation or contraction is also caused on the final image on the paper sheet. Also, sensitivity of the developing roller 312 with respect to the angular velocity variation is lower than that of the photoreceptor drum 304. Thereby, although it depends on the rotative velocity or the like, if the angular velocity variation is equal to or less than a few percent (for example, 30), the elongation or the contraction of the image is not caused. However, as in the exemplary embodiment, in the case of a structural member in which the developing roller 312 is pushed to the photoreceptor drum 304, it is preferable to prevent a contact loading variation from occurring in the developing roller 312. That is because, if the contact loading variation occurs, the urging force of the developing roller 312 with respect to the photoreceptor drum 304 may be varied, whereby there is concern that the photosensitive drum 304 itself may be displaced or the angular velocity variation of the photosensitive drum 304 may occur.

Therefore, in the exemplary embodiment, both of the reduction of the angular velocity variation which occurs in the photosensitive drum 304 and the reduction of the loading variation which occurs in the developing roller 312 are realized by adopting a different coupling structural member, which transmit the driving force, between the driving system for driving the photosensitive drum 304 and the driving system for driving the developing roller 312.

Meanwhile, a configuration in which a gear is used as a drive transmitting mechanism is also general. However, if the driving force is transmitted from the image forming apparatus main body 12 to the structural member 300 by using a gear, there is a possibility that the angular velocity variation may occur due to a shape error of the gear itself and displacement may occur due to a gear mesh reaction force. Therefore, a shaft coupling (which is a coupling) is used in the exemplary embodiment.

Figure 8:
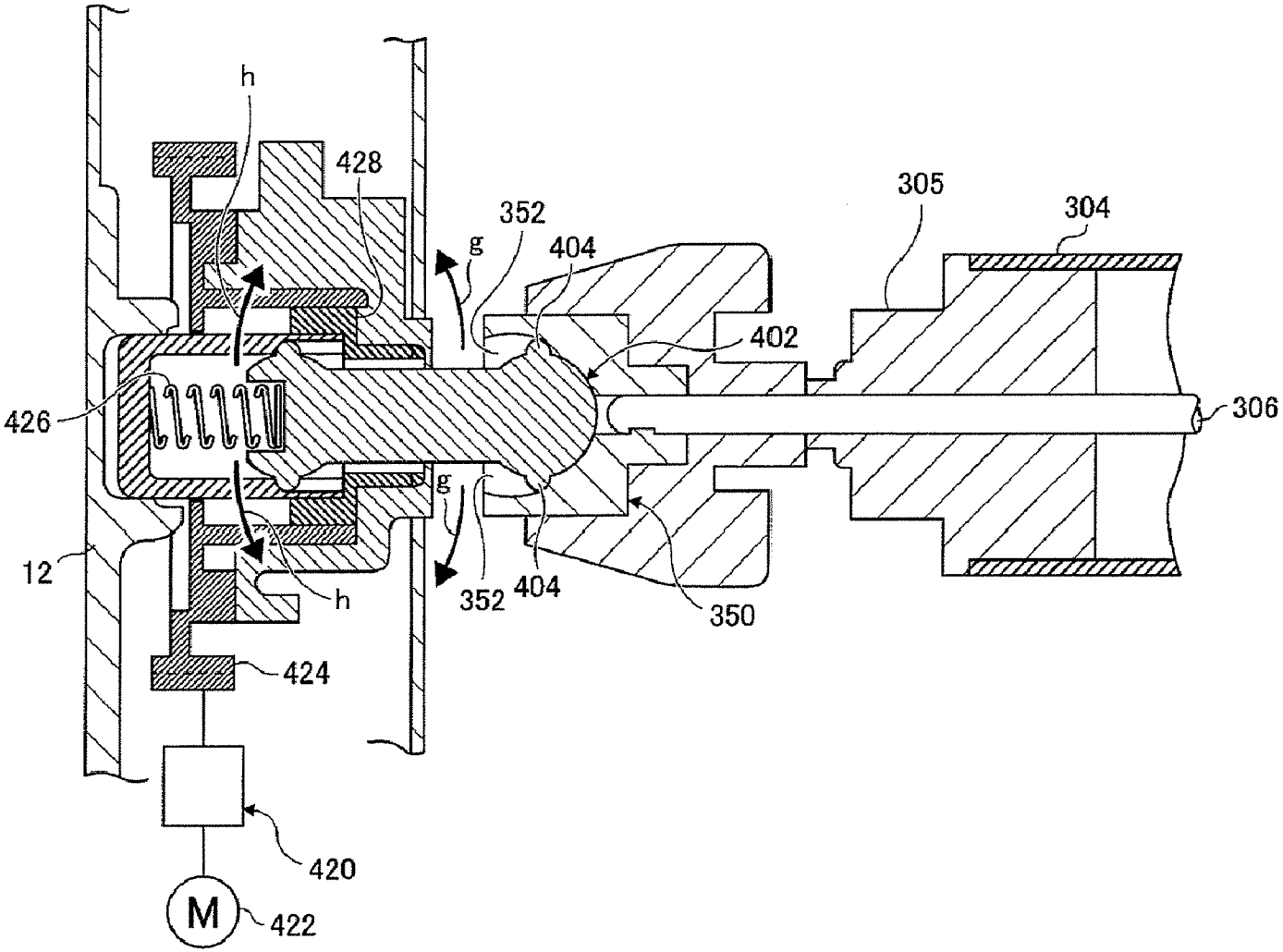
FIG. 8 shows a mechanism for transmitting a driving force to a photoreceptor in the image forming apparatus shown in FIG. 1.

FIG. 8 shows a transmitting system which transmits the driving force to the photoreceptor drum 304. Specifically, FIG. 8 shows a cross-sectional surface of the image forming apparatus 10 being cut in a plane substantially parallel to a right and left side plates of the image forming apparatus main body 12, in a state of the structural member 300 being mounted to the image forming apparatus main body 12. As shown in FIG. 8, the first driven side coupling member 350 is connected with photoreceptor drum 304. That is, a protruding portion of a shaft 306 of the photoreceptor drum 304 is mounted to the first driven side coupling member 350. Therefore, when the first driven side coupling member 350 rotates, a flange 305 holding the photoreceptor drum 304 rotates. As a result, the photoreceptor drum 304 also rotates integrally with the first driven side coupling member 350.

In addition, the first driven side coupling member 350 is connected with the first connecting member 402. That is, the first driven side coupling member 350 is connected with the first connecting member 402 such that two of the first fore-end side protrusions 404 which are formed on the first connecting member 402 are engaged with two of the first groove portions 352 which are formed on the first driven side coupling member 350, respectively. Therefore, when the first connecting member 402 rotates by receiving a transmission of the driving force from the above-mentioned driving source 422, the first driven side coupling member 350 and the photoreceptor drum 304 rotate integrally, being driven by the first connecting member 402.

As described above, two of the first fore-end side protrusions 404 are at a phase of 180 degrees and the first driven side coupling member 350 is connected with the first connecting member 402 so as to be engaged with two of the first groove portions 352 respectively. Thereby, the first connecting member 402 is inclinable with respect to the first driven side coupling member 350 in the direction of the arrow h shown in FIG. 8. Furthermore, the first connecting member 402 is inclinable, around the first fore-end side protrusions 404 serving as an imaginary axis, to the front side and back side in FIG. 8.

As shown in FIG. 8, the above-mentioned transmitting system 420 (see FIG. 6) includes a gear member 424. The gear member 424 and the first connecting member 402 are used as a first driven side coupling portion which transmits the driving force to the first driven side coupling member 350. The gear member 424 is rotatably supported against the image forming apparatus main body 12. Also, the first connecting member 402 is mounted on the gear member 424, whereby, when the driving force is transmitted from the driving source 422, the gear member 424 and the first connecting member 402 rotate integrally.

In addition, one end portion of an elastic member 426, which is formed of a coil spring or the like, is fixed to the gear member 424. The other end portion of the elastic member 426 contacts the first connecting member 402. Therefore, the first connecting member 402 is urged to the front side (that is, the right side in FIG. 8) such that the fore-end side thereof is pushed to the first driven side coupling member 350. Furthermore, a disengagement prevention member 428 is mounted on the gear member 424 for preventing a disengagement of the first connecting member 402 and the gear member 424. That is, the first connecting member 402 is movable in a front-rear direction (which is the right-left direction in FIG. 8). Therefore, when the structural member 300 is mounted to the image forming apparatus main body 12, if the engagement is incomplete due to the unmatched phase between the first fore-end side protrusion 404 and the first groove portion 352, the first connecting member 402 is evacuated to a left side. Subsequently, if the phase between the first fore-end side protrusion 404 and the first groove portion 352 is matched through rotation of the first connecting member 402, the first connecting member 402 is moved to the right side. Also, the first fore-end side protrusion 404 moves the first groove 352 to the right side, whereby the connection therebetween is completed.

Figure 9:
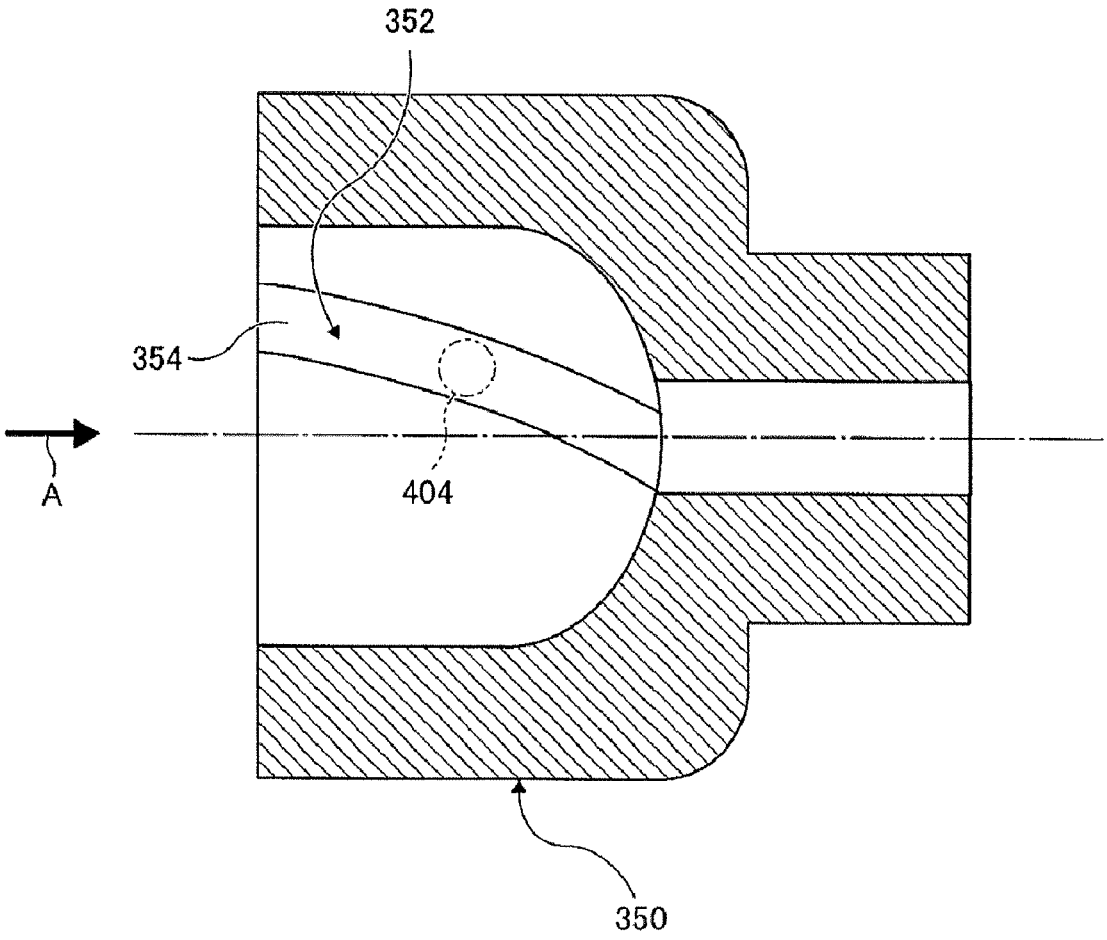
FIG. 9 is a cross-sectional view showing a first driven side coupling member which is included in the structural member shown in FIG. 2.

FIG. 9 shows a cross-sectional surface of the first driven side coupling member 350. As shown in FIG. 9, the first groove portion 352 is formed so as to be inclined in a direction in which the first connecting member 402 is mounted with respect to the first driven side coupling member 350. The inclining direction of the first groove portion 352 is defined as a direction in which, when the first connecting member 402 rotates, the first fore-end side protrusion 404 is drawn into an inside (that is, the right side in FIG. 9) of the first groove portion 352. That is, when seen from the direction of the arrow A, the first driven side coupling member 350 is rotated in a clockwise direction. Furthermore, the angle of the direction in which the first connecting member 402 is mounted is in a range from 5 degrees to 10 degrees, for example. Also, a bottom surface 354 or side surface of the first groove portion 352 is used as a first guide surface for guiding a movement of the first fore-end side protrusions 404.

Figure 10A:
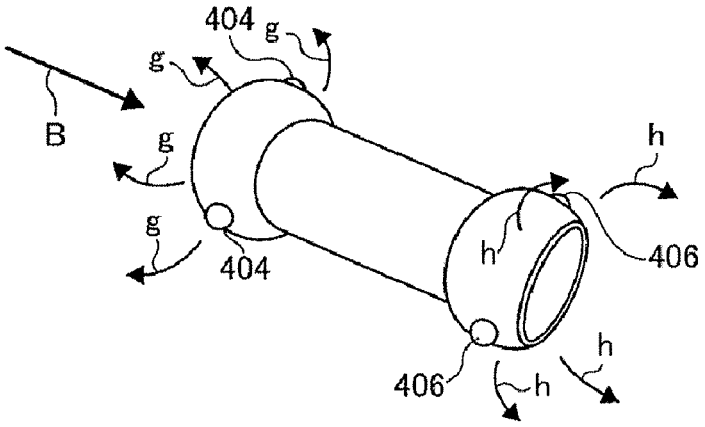
FIG. 10A is a perspective view showing the first connecting member shown in FIG. 6.
Figure 10B:
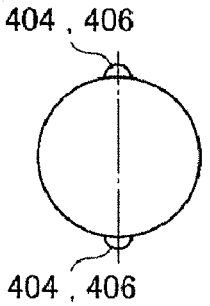
FIG. 10B is a schematic view showing the first connecting member when seen from the direction of the arrow B in FIG. 10A.

FIGS. 10A and 10B show the first connecting member 402. As described above, two of the first fore-end side protrusions 404 are formed at a phase of 180 degrees on the fore-end side of the first connecting member 402. Also, as described above, the first connecting member 402 is able to move so as to incline with respect to the first driven side coupling member 350 in the direction of the arrow g shown in FIGS. 10A and 10B (see the arrow h in FIG. 8). Moreover, as shown in FIGS. 10A and 10B, two of rear-end side protrusions 406 are formed at a phase of 180 degrees, for example, on the rear-end side of the first connecting member 402. The phase of the first fore-end side protrusions 404 and the rear-end side protrusions 406 may be configured so as to be identical as shown in FIGS. 10A and 10B or be shifted by 90 degrees.

As shown in FIG. 10B, the first connecting member 402 is inclined around imaginary axes, which combine between the first fore-end side protrusions 404 and between the rear-end side protrusions 406, as a center. Also, since the fore-end portion and rear-end portion of the first connecting member 402 are in a sphere shape, the first connecting member 402 is inclined such that one of the first fore-end side protrusions 404 (the rear-end side protrusions 406) is moved to a lower side while the other is moved to an upper side.

Figure 11:
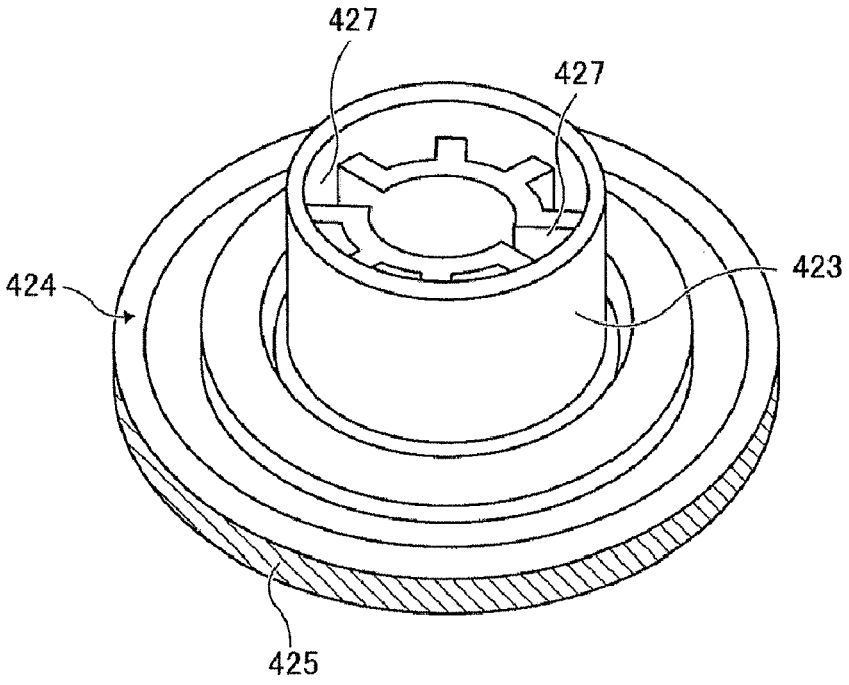
FIG. 11 shows a gear constituting a part of the mechanism for transmitting the driving force to the photoreceptor shown in FIG. 8.

The gear member 424 is shown in FIG. 11. The gear member 424 includes a large-diameter portion on which a tooth row 425 is formed and a small-diameter portion 423. Also the same number of rear-end side protrusions 406, that is, two, formed on the first connecting member 402 of groove portions 427 are formed on the small-diameter portion 423. The rear-end portion side of the first connecting member 402 is inserted into the small-diameter portion 423, in which two of the rear-end side protrusions 406 are inserted into two of the groove portions 427 respectively. Also, two of the rear-end side protrusions 406 are mounted to the gear member 424 so as to be engaged with two of the groove portions 427. Subsequently, the first connecting member 402 is able to move so as to incline with respect to the gear member 424 in the direction of the arrow h shown in FIGS. 8, 10A and 10B.

As mentioned above, the first connecting member 402 is able to move so as to incline with respect to the gear member 424 and is also able to move so as to incline with respect to the first driven side coupling member 350 as described above. Therefore, universal shaft couplings are formed between the first connecting member 402 and the second gear member 424 and between the second gear member 424 and the first driven side coupling member 350 respectively. Subsequently, the angular velocity thereof is reconciled in theory by using two of the universal shaft couplings.

Figure 12A:
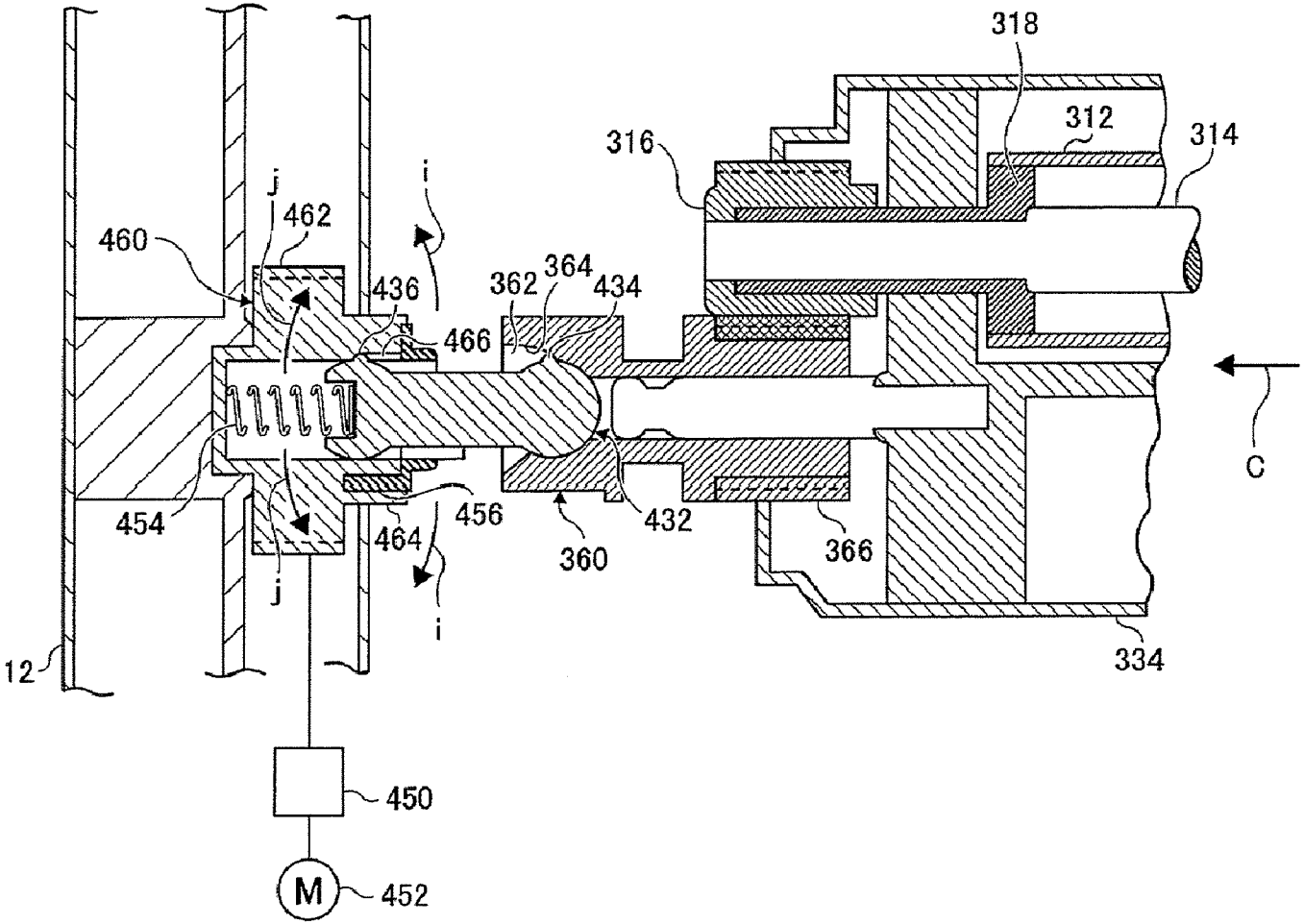
FIG. 12A shows a mechanism for transmitting the driving force to a developing roller in the image forming apparatus shown in FIG. 1.

FIG. 12A shows a transmitting system which transmits the driving force to the developing roller 312. Specifically, FIG. 12A shows a cross-sectional surface of the image forming apparatus 10 being cut in a plane substantially parallel to the right and left side plates of the image forming apparatus main body 12, in a state of the structural member 300 being mounted to the image forming apparatus main body 12. As shown in FIG. 12A, the second driven side coupling member 360 is connected with the developing roller 312. That is, a flange 318 which is mounted so as to be locked on the developing roller 312 is also locked with respect to a gear member 316. Also, the gear member 316 meshes with a gear wheel 366 which is formed on one end portion of the second driven side coupling member 360. In addition, a shaft 314 of the developing roller 312, the flange 318 and the gear member 316 slidably rotate. Therefore, when the second driven side coupling member 360 rotates, the gear member 316 receives transmission of the driving force. Thereby, the developing roller 312 rotates as well. However, magnetic pole members (not shown) which are mounted on the shaft 314 of the developing roller 312 and a periphery of the shaft 314 do not rotate.

As mentioned above, the second driven side coupling member 360 transmits the driving force to the developing roller 312 using a gear. The second driven side coupling member 360 rotates around the shaft member 336, which is provided in the second housing member 334, as a rotation center. Also, the shaft member 336 is provided so as to be coaxial with a rotation center of the second connecting member 432 and the second driven side coupling member 360. By being coaxial therewith, if a loading variation occurs between the second connecting member 432 and the second driven side coupling member 360, it is not likely that the loading variation affects the contact pressure between the photoreceptor drum 304 and the developing roller 312.

Although the driving force is transmitted from the second gear wheel 366 to the gear member 316 using a gear, a displacement or a loading variation due to a mesh reaction force hardly occurs because of the shaft 314 and the shaft member 336 being held to the second housing member 334. Furthermore, since a configuration in which the second connecting member 432 drives the developing roller 312 directly is not adopted, it is not likely that the loading variation propagates to the developing roller 312 even if the loading variation occurs between the second connecting member 432 and the second driven side coupling member 360.

In addition, the second driven side coupling member 360 is connected with the second connecting member 432. That is, the second driven side coupling member 360 is connected with the second connecting member 432 such that three of the second fore-end side protrusions 434 (see FIG. 7) which are formed on the second connecting member 432 are engaged with three of the second groove portions 362 (see FIG. 4) which are formed on the second driven side coupling member 360, respectively. Therefore, when the second connecting member 432 rotates by receiving transmission of the driving force from the above-mentioned driving source 452, the second driven side coupling member 360 and the developing roller 312 rotate, being driven by the second connecting member 432.

As described above, since the second driven side coupling member 360 is connected with the second connecting member 432 such that three of the second fore-end side protrusions 434 are engaged with three of the second groove portions 362 respectively, the second connecting member 432 is able to move so as to incline with respect to the second driven side coupling member 360 in the direction of the arrow i shown in FIG. 12A.

Figure 12B:
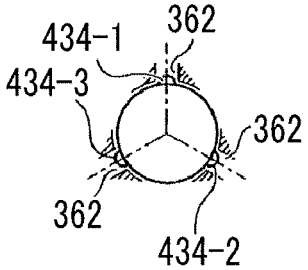
FIG. 12B is the schematic view showing the second connecting member when seen from the direction of the arrow C in FIG. 12A.

Since the second connecting member 432 has the second fore-end side protrusions 434 which are disposed at a phase of 120 degrees, an inclination of the second connecting member 432 does not occur in theory. However, the second connecting member 432 differs from the first connecting member 402 in movement. Specifically, since some extent of a gutter (interval) is provided in the second connecting member 432 in order to insert the second fore-end side protrusions 434 in the second groove portion 362, the second connecting member 432 is able to be inclined with respect to the second driven side coupling member 360 in a range of the gutter. Specifically, as schematically shown in FIG. 12B, one of the second fore-end side protrusions 434 (434-1) moves to the front side and back side in FIG. 12B around an imaginary axis, which combines the other two of the second fore-end side protrusions 434 (434-2, 434-3), serving as an imaginary axis. Also, FIG. 12B is the schematic view seen from the direction of the arrow C in FIG. 12A.

As shown in FIG. 12A, the above-mentioned transmitting system 450 (see FIG. 6) includes a gear member 460. The gear member 460 and the second connecting member 432 are used as a second driven side coupling portion which transmits the driving force to the second driven side coupling member 360. The gear member 460 is rotatably supported against the image forming apparatus main body 12. Also, the second connecting member 432 is mounted on the gear member 460, whereby, when the driving force is transmitted from the driving source 452, the gear member 460 and the second connecting member 432 rotate integrally.

One end portion of an elastic member 454, which is formed of a coil spring or the like, is fixed to the gear member 460. The other end portion of the elastic member 454 contacts the second connecting member 432. Therefore, the second connecting member 432 is urged to the front side (that is, the right side in FIG. 12A) such that the fore-end side thereof is pushed to the second driven side coupling member 360. Furthermore, a disengagement prevention member 456 is mounted on the gear member 460 for preventing a disengagement of the second connecting member 432 and the gear member 460.

As similar to the first groove portion 352 which is formed so as to incline (see FIG. 9), the second groove portion 362 is formed so as to incline with respect to a direction in which the second connecting member 432 is mounted to the second driven side coupling member 360. The inclining direction is defined as a direction in which, when the second connecting member 432 rotates, the second fore-end side protrusion 434 is drawn into an inside (that is, the right side in FIG. 12A) of the second groove portion 362. Furthermore, an inclining angle of the second groove portion 362 with respect to a direction in which the second connection member 432 is mounted is in a range from 5 degrees to 10 degrees, for example. Also, a bottom surface 364 or side surface of the second groove portion 362 is used as a second guide surface for guiding a movement of the second fore-end side protrusions 434.

As described above, three of the second fore-end side protrusions 434 and, for example, three of rear-end side protrusions 436 are respectively formed on a fore-end side and rear-end side of the second connecting member 432. FIG. 12A shows a cross-sectional surface of the second connecting member 432 but only one of the three rear-end side protrusions 436 is shown in FIG. 12A.

The gear member 460 includes a large-diameter portion on which a tooth row 462 are formed and a small-diameter portion 464. Also, the same number of rear-end side protrusions 436 that is, three, formed on the second connecting member 432 of groove portions 466 are formed on the small-diameter portion 464. Also, FIG. 12A shows a cross-sectional surface of the gear member 460 but only one of the three groove portions 466 is shown in FIG. 12A. The rear-end portion side of the second connecting member 432 is inserted into the small-diameter portion 464, in which three of the rear-end side protrusions 436 are inserted into three of the groove portions 466 respectively. Also, three of the rear-end side protrusions 436 are mounted to the gear member 460 so as to be engaged with three of the groove portions 466. Subsequently, the second connecting member 432 is able to move so as to incline with respect to the gear member 460 in the direction of the arrow j shown in FIG. 12A.

The fore-end side and rear-end side of the second connecting member 432 are in a sphere shape. The movement of the rear-end side protrusion 436 is similar to the movement of the second fore-end side protrusions 434. Also, the phases of the second fore-end side protrusions 434 and the rear-end side protrusion 436 are the same.

As described above, the second connecting member 432 is able to move so as to incline with respect to the gear member 460 and is also able to move so as to incline with respect to the second driven side coupling member 360 as mentioned above. However, since the inclination range of the second connecting member 432 is within the gutter size, incomplete universal shaft couplings are formed between the second connecting member 432 and the gear member 460 and between the gear member 460 and the second driven side coupling member 360 respectively.

Meanwhile, when there are three or more engagement places between the first fore-end side protrusion 404 and the first groove portion 352, there are cases where the driving force is transmitted by two of the engagement places. In this case, a combination of the first fore-end side protrusion 404 and the first groove portion 352 which are in contact each other and a combination of the first fore-end side protrusion 404 and the first groove portion 352 which are in incomplete contact each other are frequently switched, whereby it is likely that the angular velocity variation of the photoreceptor drum 304 may occur in a short period. Therefore, in the exemplary embodiment, the angular velocity variation is reduced in theory by providing two universal shaft couplings in the transmitting system which drives the photoreceptor drum 304.

Figure 13:
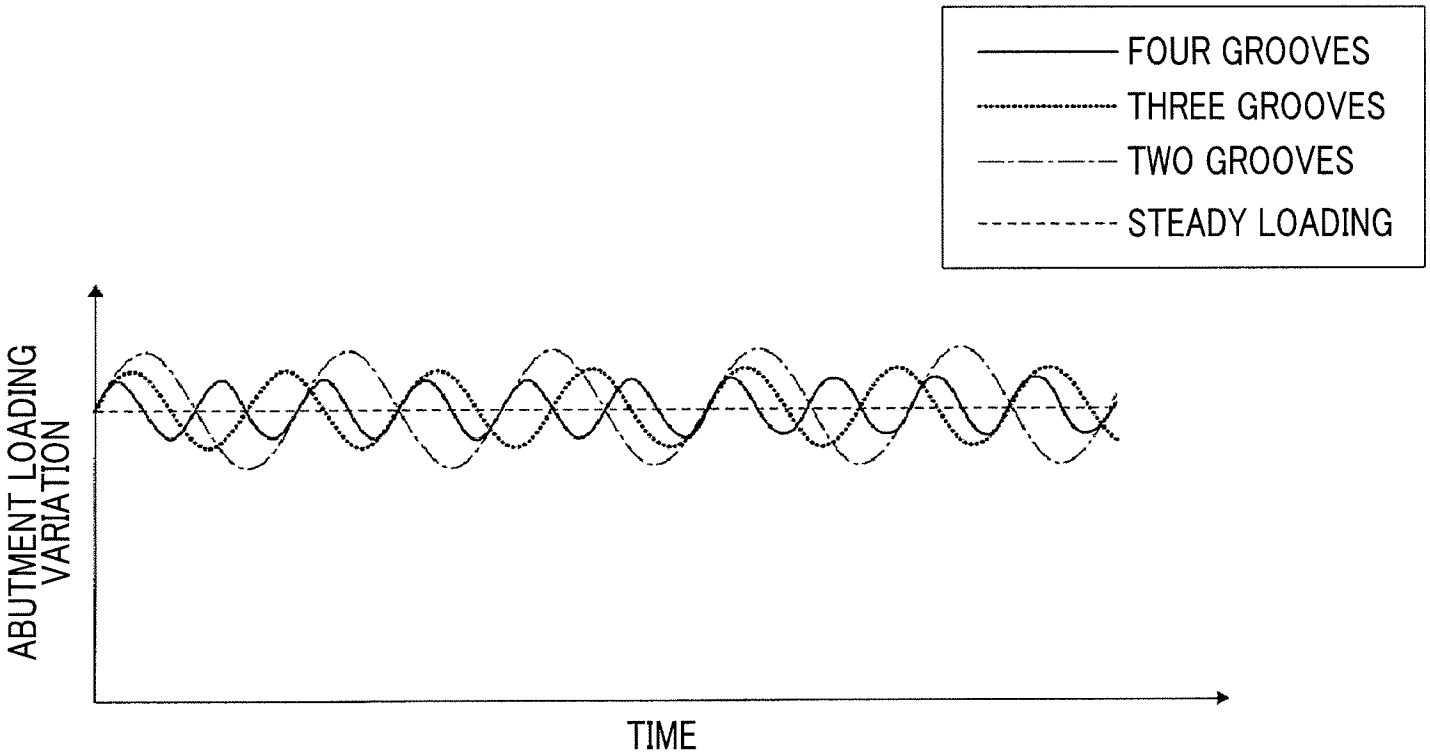
FIG. 13 is a graph showing variations associated with the time of abutment load, in which the developing roller abuts on a photoreceptor drum, corresponding to the number of protrusions which are formed on the second connecting member and the number of grooves which are formed on the second driven side coupling member, in the image forming apparatus shown in FIG. 1.

FIG. 13 schematically shows an abutment loading variation of the developing roller 312 with respect to the photoreceptor drum 304 with the passage of time, when the number of second groove portions 362 and the number of second fore-end side protrusions 434 engaged with the second groove portions 362 are changed. Additionally, the simulation result shown in FIG. 13 shows a loading variation due to changes in the number of engagement places in a state of the eccentricity or the angle of deviation. Also, the coupling structural member is not considered in the simulation. As can be seen from FIG. 13, when the number of second groove portions 362 is reduced, the period of the loading variation becomes longer and the width of the loading variation is increased. However, when the number of second groove portions 362 is increased, the period of the loading variation becomes shorter, but the width (period) of the loading variation is decreased and the maximum value thereof is also reduced. In the image forming apparatus 10, since the number of second groove portions 362 is three, the width and the maximum value of the abutment loading variation of the developing roller 312 with respect to the photoreceptor drum 304 with the passage of time become smaller compared to a case where the number of second groove portions 362 is one or two. Thereby, the adverse effect on the image quality, which is caused by the abutment loading variation of the developing roller 312 with respect to the photoreceptor drum 304, is suppressed.

Furthermore, the phases of the second fore-end side protrusions 434 and the rear-end side protrusions 436 are the same in the exemplary embodiment, but any phases may be possible instead. For example, when the second fore-end side protrusions 434 and the rear-end side protrusions 436 are shifted by 60 degrees, the period becomes shorter (specifically, similar to a period in which the number of grooves are six) than in the case of "four grooves" shown in FIG. 13. Therefore, the maximum value of the loading variation is decreased.

As described above, the present invention can be applied to an image forming apparatus such as a copier, a facsimile apparatus, and a printer, a structural member used in the image forming apparatus, and a drive transmitting mechanism.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A structural member comprising:

an image holding member that holds a latent image while being rotated;

a developing member that develops the latent image which is held by the image holding member while being rotated;

a first driven side coupling portion that is connectable to a first driving side coupling portion and transmits a driving force to the image holding member, being driven by the first driving side coupling portion; and a second driven side coupling portion that is connectable to a second driving side coupling portion and transmits the driving force to the developing member, being driven by the second driving side coupling portion, wherein the first driven side coupling portion includes a first engaged portion comprising at least one groove formed within the first engaged portion that is engaged with a first engaging portion comprising at least one protrusion which is provided on the first driving side coupling portion at no more than two engagement places, wherein the second driven side coupling portion includes a second engaged portion that is engaged with a second engaging portion which is provided on the second driving side coupling portion at three or more engagement places, and wherein the first driving side coupling portion is configured to be movable in a direction that is orthogonal to a rotation axis of the first driving side coupling portion.

2. The structural member according to claim 1, further comprising:

a first housing member that holds the image holding member inside thereof; and a second housing member that holds the developing member inside thereof and is movable with respect to the first housing member such that the developing member comes into contact with or is adjacent to the image holding member.

3. The structural member according to claim 2, wherein the first housing member and the second housing member are rotatably configured, and wherein a rotation center of the second driving side coupling portion is positioned on a rotation axis of the first housing member and the second housing member.

4. The structural member according to claim 1, wherein the first driving side coupling portion is configured to be movable forward or rearward along the direction that is orthogonal to a rotation axis of the first driving side coupling portion, and wherein the first driven side coupling portion draws the first driving side coupling portion toward the first driven side coupling portion side by being rotated.

5. The structural member according to claim 2, wherein the first driving side coupling portion is configured to be movable forward or rearward along the direction that is orthogonal to the rotation axis of the first driving side coupling portion, and wherein the first driven side coupling portion draws the first driving side coupling portion toward the first driven side coupling portion side by being rotated.

6. The structural member according to claim 3, wherein the first driving side coupling portion is configured to be movable forward or rearward along the direction that is orthogonal to the rotation axis of the first driving side coupling portion, and wherein the first driven side coupling portion draws the first driving side coupling portion toward the first driven side coupling portion side by being rotated.

7. The structural member according to claim 1, wherein the second driving side coupling portion is configured to be movable forward or rearward along the direction that is orthogonal to the rotation axis of the first driving side coupling portion, and wherein the second driven side coupling portion draws the second driving side coupling portion toward the second driven side coupling portion side by being rotated.

8. The structural member according to claim 2, wherein the second driving side coupling portion is configured to be movable forward or rearward along the direction that is orthogonal to the rotation axis of the first driving side coupling portion, and wherein the second driven side coupling portion draws the second driving side coupling portion toward the second driven side coupling portion side by being rotated.

9. The structural member according to claim 3, wherein the second driving side coupling portion is configured to be movable forward or rearward along the direction that is orthogonal to the rotation axis of the first driving side coupling portion, and wherein the second driven side coupling portion draws the second driving side coupling portion toward the second driven side coupling portion side by being rotated.

10. The structural member according to claim 4, wherein the second driving side coupling portion is configured to be movable forward or rearward along the direction that is orthogonal to the rotation axis of the first driving side coupling portion, and wherein the second driven side coupling portion draws the second driving side coupling portion toward the second driven side coupling portion side by being rotated.

11. The structural member according to claim 5, wherein the second driving side coupling portion is configured to be movable forward or rearward along the direction that is orthogonal to the rotation axis of the first driving side coupling portion, and wherein the second driven side coupling portion draws the second driving side coupling portion toward the second driven side coupling portion side by being rotated.

12. The structural member according to claim 6, wherein the second driving side coupling portion is configured to be movable forward or rearward along the direction that is orthogonal to the rotation axis of the first driving side coupling portion, and wherein the second driven side coupling portion draws the second driving side coupling portion toward the second driven side coupling portion side by being rotated.

13. An image forming apparatus comprising:

a structural member that is attached to/detached from an image forming apparatus main body; and a first driving side coupling portion and a second driving side coupling portion that transmit a driving force to the structural member, wherein the structural member includes:

an image holding member that holds a latent image while being rotated;

a developing member that develops the latent image which is held by the image holding member while being rotated;

a first driven side coupling portion that is connectable to a first driving side coupling portion and transmits a driving force to the image holding member, being driven by the first driving side coupling portion; and a second driven side coupling portion that is connectable to a second driving side coupling portion and transmits the driving force to the developing member, being driven by the second driving side coupling portion, wherein the first driven side coupling portion includes a first engaged portion comprising at least one groove formed within the first engaged portion that is engaged with a first engaging portion comprising at least one protrusion which is provided on the first driving side coupling portion at no more than two engagement places, wherein the second driven side coupling portion includes a second engaged portion that is engaged with a second engaging portion which is provided on the second driving side coupling portion at three or more engagement places, and wherein the first driving side coupling portion is configured to be movable in a direction that is orthogonal to a rotation axis of the first driving side coupling portion.

14. A drive transmitting mechanism comprising:

a first driving side coupling portion and a second driving side coupling portion that transmit a driving force;

a first driven side coupling portion that is connectable to a first driving side coupling portion and transmits a driving force to a first rotating member, being driven by the first driving side coupling portion; and a second driven side coupling portion that is connectable to a second driving side coupling portion and transmits the driving force to a second rotating member, being driven by the second driving side coupling portion, wherein the first driven side coupling portion includes a first engaged portion comprising at least one groove form within the first engaged portion that is engaged with a first engaging portion comprising at least one protrusion which is provided on the first driving side coupling portion at no more than two engagement places, wherein the second driven side coupling portion includes a second engaged portion that is engaged with a second engaging portion which is provided on the second driving side coupling portion at three or more engagement places, and wherein the first driving side coupling portion is configured to be movable in a direction that is orthogonal to a rotation axis of the first driving side coupling portion.

* * * * *